US009340342B2

(12) United States Patent
Brandon, II

(10) Patent No.: US 9,340,342 B2
(45) Date of Patent: May 17, 2016

(54) PRODUCT PACKAGING HAVING MAGNETIC ACTIVATED TEST MODE

(71) Applicant: Energizer Brands, LLC, St. Louis, MO (US)

(72) Inventor: Michael J. Brandon, II, North Ridgeville, OH (US)

(73) Assignee: Energizer Brands, LLC, St. Louis, MO (US)

( * ) Notice: Subject to any disclaimer, the term of this patent is extended or adjusted under 35 U.S.C. 154(b) by 0 days.

(21) Appl. No.: 14/444,209

(22) Filed: Jul. 28, 2014

(65) Prior Publication Data

US 2016/0023827 A1 Jan. 28, 2016

(51) Int. Cl.

| | |
|---|---|
| ***B65D 75/36*** | (2006.01) |
| ***B65D 73/00*** | (2006.01) |
| ***B65B 15/00*** | (2006.01) |
| ***B65B 61/20*** | (2006.01) |

(52) U.S. Cl.

CPC ..... *B65D 75/366* (2013.01); *B65B 15/00* (2013.01); *B65B 61/20* (2013.01); *B65D 73/0014* (2013.01); *B65D 2201/00* (2013.01)

(58) Field of Classification Search

CPC ..... B65D 75/366; B65D 2201/00

See application file for complete search history.

(56) References Cited

U.S. PATENT DOCUMENTS

| | | | | |
|---|---|---|---|---|
| 4,830,005 | A | 5/1989 | Woskow | |
| 7,465,060 | B2 | 12/2008 | Opolka | |
| 7,852,181 | B2 | 12/2010 | Opolka | |
| 7,976,177 | B2 | 7/2011 | Dikopf | |
| 2009/0168088 | A1 * | 7/2009 | Rosenblatt | 358/1.12 |
| 2011/0188229 | A1 | 8/2011 | Rizo Hernandez | |

FOREIGN PATENT DOCUMENTS

| | | | |
|---|---|---|---|
| DE | 202006018444 | U1 | 2/2007 |
| TW | M256867 | U | 2/2005 |

* cited by examiner

*Primary Examiner* — Mohamad Musleh
(74) *Attorney, Agent, or Firm* — McDonald Hopkins LLC

(57) ABSTRACT

A packaged product is provided. The packaged product includes a package and a magnet fixedly disposed within the package. The packaged product also includes an electrically powered device disposed in the package. The device includes a magnetic switch disposed in close proximity to the magnet such that the magnet actuates the magnetic switch. The device operates in a test mode when the magnet is in close proximity to the magnetic switch and operates in a normal use mode when the device is removed from the package such that the magnet is no longer in close proximity to the magnetic switch.

14 Claims, 4 Drawing Sheets

PRODUCT PACKAGING HAVING MAGNETIC ACTIVATED TEST MODE

FIELD OF THE INVENTION

The present invention generally relates to product packaging, and more particularly relates to the packaging of an electrically powered device that allows for operation of the device in a test mode.

BACKGROUND OF THE INVENTION

Many electrically powered devices are typically disposed in a package for display and sale to consumers. The packaging typically includes one or more layers of cardboard and/or blister package which may partially or completely encase the device. Some product packages allow a user to interface with the device and operate the device in a test mode, also referred to as a "try me" mode, which enables a consumer to test the operation and performance of the device prior to purchasing the packaged product. Packaged products offering a test mode often require reconfiguration of the device to switch between the test mode and normal use mode of operation or require additional moving components at an increased cost and complexity. It would be desirable to provide for a packaged product which allows a consumer to test the product in the package and subsequently use the device without reconfiguring the device and with minimal complexity and labor.

SUMMARY OF THE INVENTION

According to a first aspect of the present invention a packaged product is provided. The packaged product includes a package, a magnet fixedly disposed within the package, and an electrically powered device disposed in the package. The device includes a magnetic switch disposed in close proximity to the magnet such that the magnet actuates the magnetic switch, wherein the device operates in a test mode when the magnet is in close proximity to the magnetic switch.

Embodiments of the first aspect of the invention can include any one or a combination of the following features:

- the device further includes a user actuated input, wherein a user may actuate the input to activate the device in the test mode and may further operate the device in a use mode;
- the user actuated input includes a switch that turns the device on and off in the use mode and activates the device in the test mode; the switch can be a pushbutton switch; the switch can be a toggle switch; the switch can be a slide switch;
- the device includes control circuitry for controlling the device to operate in the test mode when the magnet is in close proximity to the magnetic switch and to operate in a use mode when the magnet is no longer in close proximity to the magnetic switch;
- the control circuitry operates the device for a predetermined time period in the test mode and thereafter turns off the device;
- the package includes front and rear cards, wherein the magnet is disposed between the front and rear cards;
- the device is a lighting device; and
- the magnetic switch includes a reed switch or hall effect switch.

A second aspect of the present invention includes a packaged product. The packaged product includes a package, a magnet disposed within the package, and an electrically powered device disposed in the package. The device includes a magnetic switch disposed in close proximity to the magnet such that the magnet actuates the magnetic switch. The device further comprises a user actuated input activatable by a user to operate the device in a use mode and to activate the device in a test mode. The device operates in the test mode when the magnet is in close proximity to the magnetic switch.

Embodiments of the second aspect of the invention can include any one or a combination of the following features:

- the user actuated input includes a switch that turns the device on and off in the use mode and activates the device in the test mode, the switch can be a pushbutton switch; the switch can be a toggle switch; the switch can be a slide switch;
- the device includes control circuitry for controlling the device to operate in the test mode when the magnet is in close proximity to the magnetic switch and to operate in the use mode when the magnet is no longer in close proximity to the magnetic switch;
- the control circuitry operates the device for a predetermined time period in the use mode and thereafter turns off the device;
- the package includes front and rear cards, wherein the magnet is disposed between the front and rear cards;
- the device is a lighting device;
- the magnetic switch comprises a reed switch or hall effect switch; and
- the magnet is fixedly disposed within the package.

A third aspect of the present invention is a method of packaging an electronic device to include a test mode to test the device. The method includes the steps of providing a package, fixedly disposing a magnet within the package, and disposing an electrically powered device in the package. The device includes a magnetic switch disposed in close proximity to the magnet such that the magnet actuates the magnetic switch, wherein the device operates in a test mode when the magnet is in close proximity to the magnetic switch.

Embodiments of the third aspect of the invention can include any one or a combination of the following features:

- the step of actuating a user actuated input on the device when the device is attached to the package in close proximity to the magnet so as to activate the device in a test mode;
- the step of removing the device from the package so that the magnet is no longer in close proximity to the magnetic switch;
- the step of actuating the user actuated input when the device is removed from the package so as to operate the device in a use mode;
- the device is operated for a predetermined time in the test mode and thereafter turned off; and
- the step of fixedly disposing a magnet in the package includes disposing the magnet between two layers of material such that the magnet is hidden from view.

These and other features, advantages, and objects of the present invention will be further understood and appreciated by those skilled in the art by reference to the following specification, claims, and appended drawings.

DETAILED DESCRIPTION OF THE PREFERRED EMBODIMENTS

The present invention provides for a packaged product that includes a package, a magnet disposed within the package, and an electrically powered device disposed on the package. The device includes a magnetic switch disposed in close proximity to the magnet such that the magnet actuates the magnetic switch. The device operates in a test mode when the magnet is in close proximity to the magnetic switch. The device includes a user actuated input, wherein a user may actuate the input to activate the device in the test mode and may further operate the device in a use mode. The user actuated input may include a switch that turns the device on and off in the use mode and activates the device in the test mode. Control circuitry controls the device to operate in the test mode when the magnet is in close proximity to the magnetic switch and to operate in the use mode when the magnet is no longer in close proximity to the magnetic switch. The control circuitry operates the device for a predetermined time in the test mode and thereafter turns off the device. The package may include front and rear cards, wherein the magnet is disposed between the front and rear cards and hidden from view.

Figure 2:
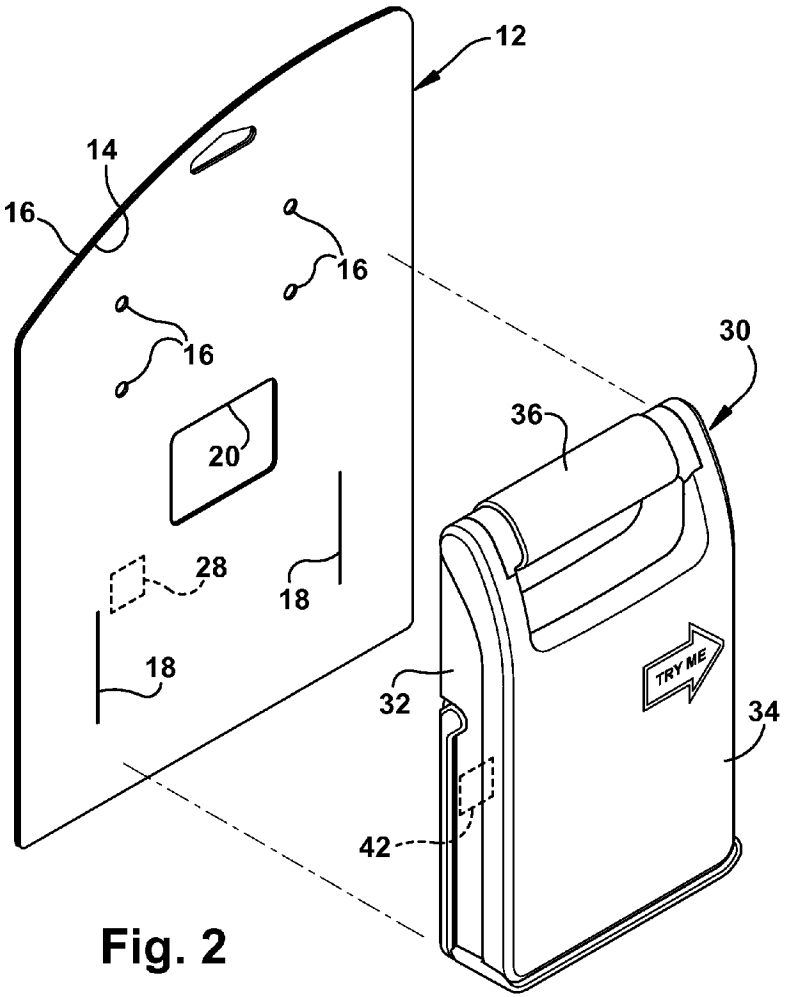
FIG. 2 is an exploded view of the packaged product showing the electronically powered device separated from the package.
Figure 1:
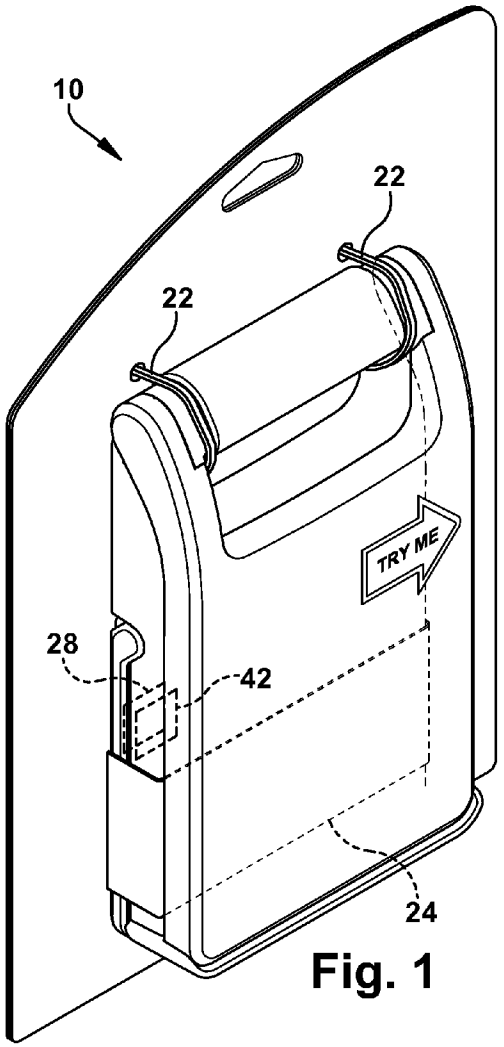
FIG. 1 is a front perspective view of a packaged product employing a magnet and an electrically powered device having a magnetic switch configured to operate in a test mode, according to one embodiment.
Figure 3:
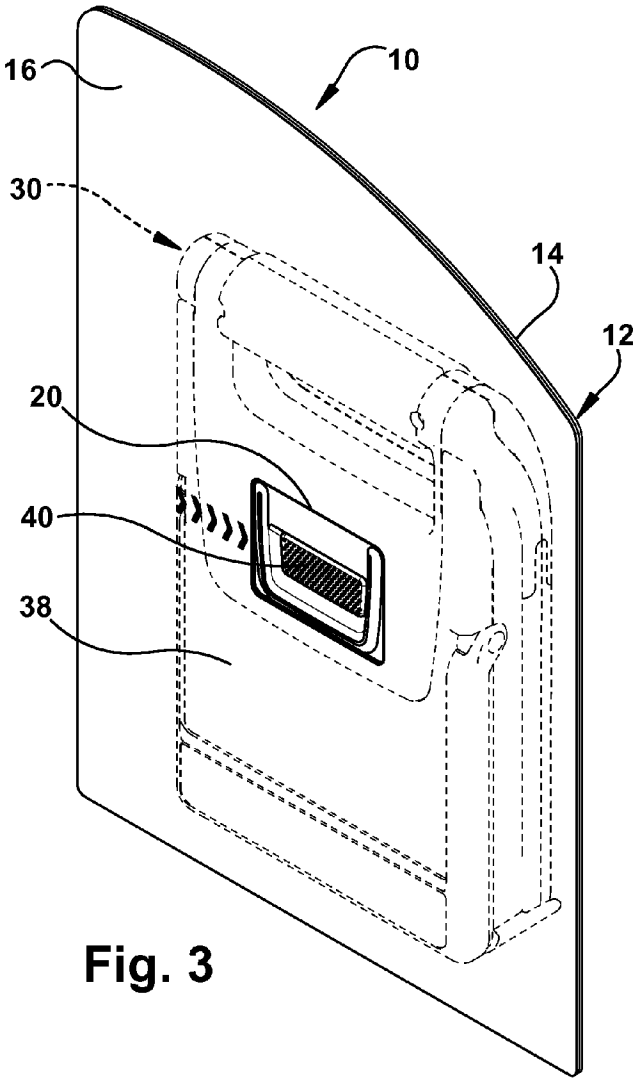
FIG. 3 is a rear perspective view of the packaged product.

Referring now to FIGS. 1-3, a packaged product 10 is generally illustrated according to one embodiment. The packaged product 10 generally includes a package 12 configured to engage and retain an electrically powered device 30 in a manner that is presentable to a consumer and may be displayed in a retail store. The electrically powered device 30 includes a magnetic switch 42 that is actuatable by a magnet to switch between first and second states. When a magnet is in close proximity to the magnetic switch 42, the switch 42 is actuated by the magnetic field of the magnet to the first state which may be a closed contact state. When the magnetic switch 42 is no longer in close proximity to a magnet, the magnetic switch 42 may switch to the second state which may be a normally open contact state. The switch state may be used to control operation of the electrically powered device 30 between first and second modes. The first mode may include a "try me" or test mode, and the second mode may include a normal use mode in which the device operates in its normally intended manner. The test mode enables a user to test the operation and performance of the electrically powered device 30 without removing the device 30 from the package 12.

The packaged product 10 includes a magnet 28 fixedly disposed within the package 12. The magnet 28 is located in the package 12 such that it is in close proximity to the magnetic switch 42 so that its magnetic field actuates the magnetic switch 42 to the first state when the electrically powered device 30 is disposed on the package 12. Thus, when the electrically powered device 30 is disposed on the package 12, the device 12 operates in the test mode due to actuation of the magnetic switch 42 by the magnet 28. In the test mode, a user may actuate a user actuated input of the device 30, which in one embodiment is a pushbutton switch on the rear side 38 as shown in FIG. 3. Other types of switches (e.g., toggle and slide switches) and other methods of user actuation may be used. The user actuated input 40, shown as a pushbutton switch, is depressible by a user to turn the electrically powered device 30 on and off. The user actuated pushbutton input 40 is arranged proximate to an opening 20 provided in the package 12 such that a user may access and actuate the pushbutton input 40 (through the opening 20 on the rear side 38 of the package 12 for example).

The package 12 is shown as a folded over packaging card having two overlapping layers. However, it should be appreciated that the package 12 may include one or more layers, according to other embodiments. In the embodiment shown, the package 12 has a front layer or card 14 adhered to a rear layer or card 16. The use of front and rear cards 14 and 16 adhered together to form a sandwich package enables the insertion of the magnet 28 between the two layers 14 and 16 such that the magnet 28 is hidden from view by a consumer. As such, a user may remove the device 30 from the package 12 and dispose of the magnet 28 with the package 12 such that a consumer does not view or identify the presence of the magnet 28.

The package 12 is further shown including optional retention openings 16 which receive a pair of upper retention members 22 such as straps or wires that engage a handle portion 36 of device 30 to retain the handle portion 36 on the package 12. Upper retention members 22 may include polymeric retention clips, according to one embodiment. The package 12 further includes a pair of slits 18 that receive a lower retention member 24 such as a strap or band that retains the lower portion of the device 30 fixedly connected to the package 12. Lower retention member 24 may include a cardboard strip or other material that retains device 30 in place on package 12. It should be appreciated that other shapes and sizes of packages and arrangements of the retention features for retaining the device 30 on package 12 may be employed. For example, the device 30 may be retained by a transparent blister secured to the front card 14.

The electrically powered device 30 is shown and described herein as a portable lighting device, such as a handheld lantern according to one embodiment. The lighting device 30 includes a base 32 and a pivoting front lighting portion 34 that pivots relative to the base 32. In addition, the device 30 has handle portion 36. The lighting device 30 has a normal use mode in which actuation of the pushbutton input 40 turns the light source on or off. It should be appreciated that the packaged product 10 may include other electrically powered devices, such as flashlights, toys, audio devices, display devices, or other devices that offer a "try me" or test mode in addition to a normal use mode.

Figure 4:
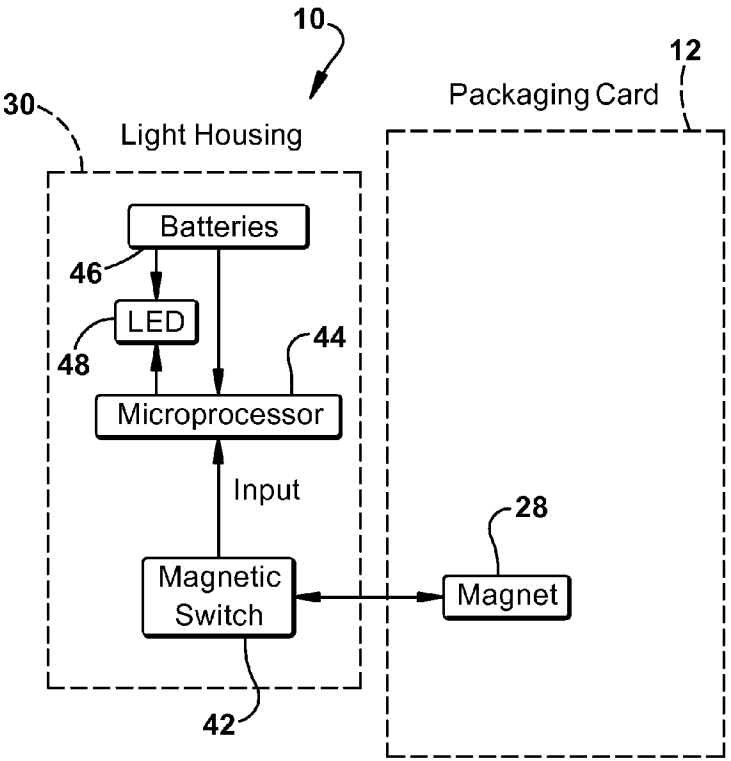
FIG. 4 is a block diagram illustrating components of the packaged product.

Various components of the packaged product 10 are further illustrated in FIG. 4. The magnet 28 is generally shown provided within packaging card 12, preferably at a location hidden from view by a consumer. The electrically powered device 30 is shown as a lighting device having an electrical power source including one or more batteries 46 and one or more lighting elements such as light emitting diode (LED) 48. The lighting device 30 includes a magnetic switch 42 which is actuatable by the magnet 28 within the packaging card 12 when in close proximity thereto. The lighting device 30 can further include control circuitry for controlling the device 30 to operate in the test mode when the magnet 28 is in close proximity to the magnetic switch 42 and to operate in the normal use mode when the magnet 28 is no longer in close proximity to the magnetic switch 42. The control circuitry may include a microprocessor 44, according to one embodiment. It should be appreciated that other analog and/or digital circuitry may be employed to control the device 30 and its operation in both the test mode and normal use mode of operation.

Figure 5:
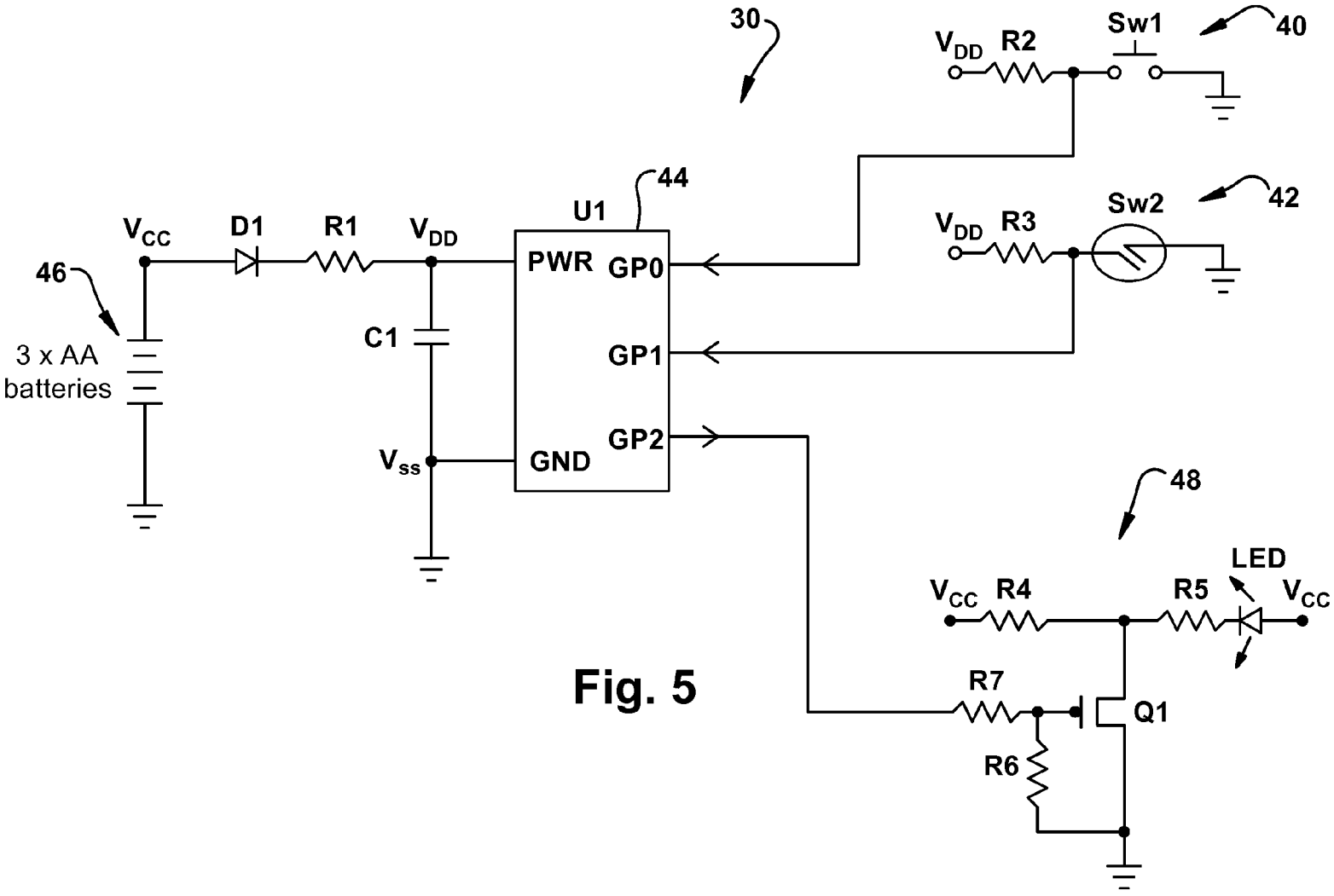
FIG. 5 is a circuit diagram illustrating the control circuitry of the packaged product.

The control circuitry employed in the electrically powered device 30 is illustrated in FIG. 5, according to one embodiment. Electrical power is provided by the one or more batteries 46 which supply electrical current through diode Dl, resistor R1, and across capacitor C1. The microprocessor 44 receives power at power supply inputs PWR and GND from the one or more batteries 46. The microprocessor 44 receives an input at pin GPO from the on/off pushbutton input 40 indicative of the "on" or "off" state of the input. In the closed state, pushbutton switch 40 generates a signal across resistor R2. Microprocessor 44 also receives an input at pin GP1 from the magnetic switch 42 indicative of the first or second state of the magnetic switch 42. In the closed state, magnetic switch 42 generates a signal across resistor R3. The microprocessor 44 provides as an output at pin GP2 an analog output to control the light source 48 to turn the light source 48 on and off. The light source 48 is shown as an LED and has resistors R4-R7 and transistor Q1. Operation of the light source 48 may depend upon whether the device 30 is operated in the test mode or the normal use mode. When operated in the test mode, the device 12 may be controlled such that the light source 48 is activated for a limited predetermined time, such as ten seconds, and then turned off thereafter. This allows a consumer to try out or test the device while minimizing the amount of battery power that is consumed. In contrast, the light source would not turn off upon expiration of the predetermined time when operated in the normal use mode.

Figure 6:
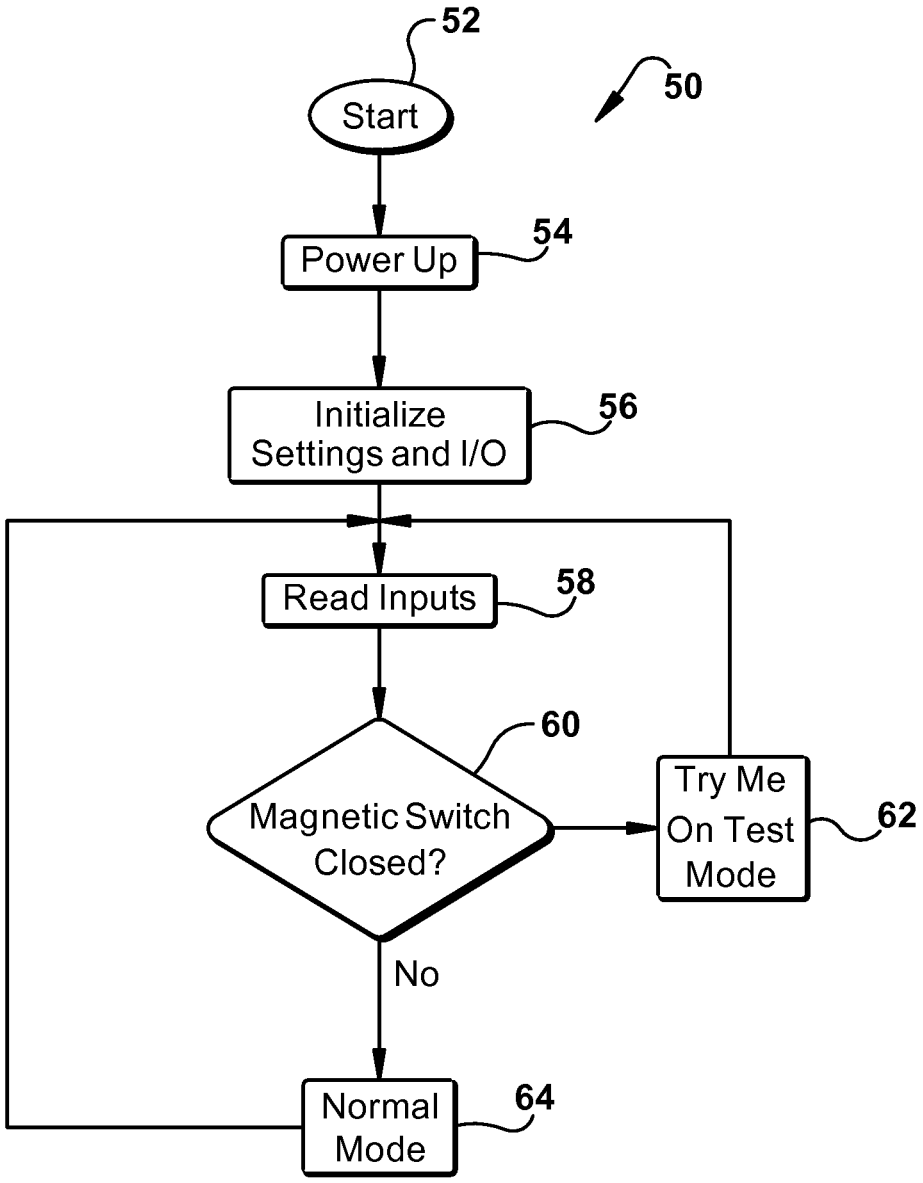
FIG. 6 is a flow diagram illustrating the control logic for controlling the device in the test mode and normal use mode of operation.

Referring to FIG. 6, the control logic for operating the electrically powered device in the test and normal use modes is illustrated, according to one embodiment. Routine 50 begins at step 52 and proceeds to power up at step 54. Next, an initialization of the settings in the inputs/outputs is performed at step 56. The various inputs to the microprocessor are read at step 58. Proceeding to decision step 60, if the magnetic switch is closed, the device proceeds to the "try me" or test mode at step 62. This occurs when the magnetic switch is in close proximity to the magnet which occurs when the device 30 is disposed on the package 12. When the magnetic switch is no longer closed, which occurs when the magnet is not in close proximity to the magnetic switch, routine 50 proceeds to the normal use mode at step 64. In the normal use mode, the electrically powered device operates in its normally intended manner.

A method of packaging the electrically powered device 30 to include a test mode to test the device will now be described. The method includes providing a package, disposing a magnet within the package, and disposing an electrically powered device in the package. The device includes a magnetic switch disposed in close proximity to the magnet such that the magnet actuates the magnetic switch. The device operates in a test mode when the magnet is in close proximity to the magnetic switch. The method may include the step of actuating a user actuated input on the device when the device is attached to the package in close proximity to the magnet so as to activate the device in a test mode. The method may further include removing the device from the package so that the magnet is no longer in close proximity to the magnetic switch. The method may further include actuating the user actuated input when the device is removed from the package so as to operate the device in a use mode.

Accordingly, the packaged product 10 advantageously provides for the packaging of an electronically powered device within a package with a test or "try me" mode that does not require extra components and labor and does not require reconfiguration of the device to switch between the test and use modes. A consumer may simply remove the electrically powered device 30 from the package 12 to automatically change operating modes of the device from the test mode to the normal use mode.

While the invention has been described in detail herein in accordance with certain preferred embodiments thereof, many modifications and changes therein may be affected by those skilled in the art without departing from the spirit of the invention. Accordingly, it is our intent to be limited only by the scope of the appending claims and not by way of the details and instrumentalities describing the embodiments shown herein.

What is claimed is:

1. A packaged product comprising:

a package;

a fixed magnet disposed in a non-moving position within the package; and an electrically powered device disposed in the package, said device comprising a control circuit operatively associated with a magnetic switch disposed in close proximity to the magnet such that the magnet actuates the magnetic switch, said device further comprising a user actuated input, wherein said user actuated input causes the circuit to operate the device in a test mode when the fixed magnet is in close proximity to the magnetic switch and in a user mode when the device is not disposed in the package.

2. The packaged product of claim 1, wherein the user actuated input is selected from: pushbutton switch, a toggle switch and slide switch, and wherein the user actuated input turns the device on and off in the use mode and activates the device in the test mode.

3. The packaged product of claim 2, wherein the control circuit operates the device for a predetermined time period in the use mode and thereafter turns off the device.

4. The packaged product of claim 2, wherein the user actuated input is accessible to a user when the device is disposed within the package.

5. The packaged product of claim 1, wherein the package comprises front and rear cards, wherein the magnet is disposed between the front and rear cards.

6. The packaged product of claim 1, wherein the device is a lighting device.

7. The packaged product of claim 1, wherein the magnetic switch comprises a reed switch.

8. The packaged product of claim 1, wherein the magnetic switch comprises a hall effect switch.

9. The packaged product of claim 1, wherein the control circuit comprises a microprocessor disposed within the device, said microprocessor also controlling operation of the device in user mode.

10. A lighting device packaged for sale to consumers comprising:

a lighting device including a control circuit operatively connected to user actuated input and a magnetic switch;

a package including a magnet fixed in a non-moving position on the package;

wherein the lighting device is disposed at least partially in the package so that the user actuated input is accessible for activation and the magnet is proximate to the magnetic switch; and wherein, when the user actuated input is activated, the control circuit activates the lighting device as follows: a) if the magnetic switch is proximate to the magnet, the lighting device is activated in test mode, and b) if the magnetic switch is not proximate to the magnet, the lighting device is activated in user mode.

11. The lighting device of claim 10, wherein the magnetic switch includes a hall effect switch.

12. The lighting device of claim 10, wherein the magnet is held between a front card and a rear card so as to conceal the magnet within the packaging.

13. The lighting device of claim 10, wherein the package includes an opening so as to allow a user to directly access to the user actuated input.

14. The lighting device of claim 10, wherein the control circuit is a microprocessor.

* * * * *